US006255590B1

(12) United States Patent
Sato

(10) Patent No.: US 6,255,590 B1
(45) Date of Patent: Jul. 3, 2001

(54) METHOD OF CONNECTING LEAD WIRE TO SHIELD OF SHIELDED CABLE AND SHIELDED CABLE WITH LEAD WIRE CONNECTED THEREBY

(75) Inventor: Kei Sato, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/294,142

(22) Filed: Apr. 20, 1999

(30) Foreign Application Priority Data

Apr. 22, 1998 (JP) ..... 10-111905

(51) Int. Cl.[7] ..... H01R 4/00
(52) U.S. Cl. ..... 174/84 R; 174/74 R; 174/78
(58) Field of Search ..... 174/84 R, 94 R, 174/84 C; 29/872, 868

(56) References Cited

U.S. PATENT DOCUMENTS 3,857,995 * 12/1974 Wyrick ..... 174/84 C
5,584,122 * 12/1996 Kato et al. ..... 29/872
5,722,841 * 3/1998 Wright ..... 439/98
5,821,462 * 10/1998 Raleigh et al. ..... 174/79
5,869,784 * 2/1999 Shinchi ..... 174/84 R
5,925,202 * 7/1999 Ide et al. ..... 156/73.2
5,962,813 * 10/1999 Shirako et al. ..... 174/88 R
6,046,407 * 4/2000 Ide ..... 174/78
6,072,123 * 6/2000 Ide et al. ..... 174/78
6,072,124 * 6/2000 Kato et al. ..... 174/84 R

FOREIGN PATENT DOCUMENTS 5-15359 2/1993 (JP) .
6-349532 12/1994 (JP) .

* cited by examiner

*Primary Examiner*—Dean A. Reichard
*Assistant Examiner*—William H. Mayo, III
(74) *Attorney, Agent, or Firm*—Armstrong, Westerman, Hattori, McLeland & Naughton, LLP

(57) ABSTRACT

A method of connecting a lead wire to a shield of a shielded cable. The method contains the steps of placing a lead wire on a shielded cable, and then subjecting the lead wire and the shielded cable to ultrasonic welding such that a conductor of the lead wire is joined to a shield of the shielded cable. The conductor of the lead wire is easily and reliably connected to the shield of the shielded cable, such as a shielding braid.

7 Claims, 4 Drawing Sheets

METHOD OF CONNECTING LEAD WIRE TO SHIELD OF SHIELDED CABLE AND SHIELDED CABLE WITH LEAD WIRE CONNECTED THEREBY

BACKGROUND OF THE INVENTION

1. Field of the Invention

This invention relates to a method of easily and reliably connecting the conductor of a lead wire to the shield of a shielded cable such as a braid. This invention also relates to a shielded cable, with a lead wire connected thereto by the above method.

2. Description of the Related Art

FIGS. 6 and 7 show a conventional shield connection means for a shielded cable disclosed in Japanese Patent Application Unexamined Publication No. 6-349532.

This connection means, as shown in FIG. 6, consists of exposing a shielding braid 32 from a shielded cable 31, fitting a relay connecting element in the form of a metallic sleeve terminal 33 over the braid 32 and, as shown in FIG. 7, inserting a terminal 35 attached at the end of the shielded cable 31 into a connector housing 34 to bring a skirt 37 of the sleeve terminal 33 into contact with a shielding metallic shell 36 of the connector housing 34.

The terminal 35 is crimped on, and connected to, the conductor 38 of the shielded cable 31. The conductor 38 is covered with an inner cover 39. The braid 32 is disposed peripherally around the inner cover 39 and is in turn covered with an outer cover 40. The connector housing 34, the terminal 35 and the metallic shell 36 constitute a connector 41. On fitting a mating connector (not shown) to the connector 41, the metallic shell 36, and thus the braid 32 of the shielded cable 31, are connected to a not-shown metallic shell of the mating connector. The metallic shell 36 is grounded through the braid 32. It is to be noted here that the braid 32 may be replaced by copper foil, if desired, to constitute the shield.

With the conventional connection means, however, an operator needs to do the troublesome work of peeling the outer cover 40 from the shielded cable 31 to expose the braid 32 and then fitting the sleeve terminal 33 over the braid 32, resulting many manhours spent in processing the end of the shielded cable 31. The connection of the braid 32 of the shielded cable 31 to the connector side (to the metallic shell 36 in the present example) has thus been troublesome. Further, due to the structure in which the sleeve terminal 33 is pressed on the braid 32, these elements tend to become loose relative to each other, resulting in a possible contact failure between them. Likewise, due to the structure in which the skirt 37 of the sleeve terminal 33 resiliently contacts the metallic shell 36, the force with which the skirt 37 contacts the metallic shell 36 tends to disadvantageously decrease as time elapses. Further, the skirt 37 of the sleeve terminal 33 is susceptible to deformation in case the shielded cable 31 is forcibly swung in a radial direction on FIG. 7, resulting in an incomplete contact with the metallic shell 36.

SUMMARY OF THE INVENTION

This invention has been accomplished to overcome the above drawbacks and an object of this invention is to provide a connection method for a shielded cable, which enables, with few manhours, an easy connection between shields of the shielded cable, such as a braid and of the connector, which receives the shielded cable, and which prevents deterioration with time in the contact between the shields, thereby attaining an improved reliability in their electrical connection.

In order to attain the object, according to an aspect of this invention, there is provided a method of connecting a lead wire to a shield of a shielded cable, comprising the steps of: placing a lead wire on a shielded cable; and then subjecting the lead wire and the shielded cable to ultrasonic welding such that a conductor of the lead wire is joined to a shield of the shielded cable.

Preferably, the shielded cable has a first terminal attached thereto and the lead wire has a second terminal attached thereto, and the step of placing the lead wire on the shielded cable comprises inserting the first and second terminals in vertically aligned tiers into a connector housing to place the lead wire in a parallel manner on the shielded cable.

Preferably, the step of ultrasonic welding is effected using an ultrasonic welding horn with a first positioning depression for the shielded cable and a second positioning depression for the lead wire.

Preferably, the second positioning depression for the lead wire is located at a circumferential center of the first positioning depression for the shielded cable.

Preferably, the shield of the shielded cable is a shielding braid.

Preferably, the shield of the shielded cable is copper foil.

According to another aspect of this invention, there is provided a shielded cable with a lead wire connected to a shield thereof, the lead wire being connected to the shield by a method comprising the steps of: placing a lead wire on a shielded cable; and then subjecting the lead wire and the shielded cable to ultrasonic welding such that a conductor of the lead wire is joined to a shield of the shielded cable.

The above and other objects, features and advantages of this invention will become apparent from the following description and the appended claims, taken in conjunction with the accompanying drawings.

DESCRIPTION OF THE PREFERRED EMBODIMENT

An embodiment of this invention will now be described, purely by way of example, with reference to the attached drawings.

FIGS. 1 to 5 show a connection method (connection structure) for a shielded cable according to one embodiment of this invention.

Figure 1:
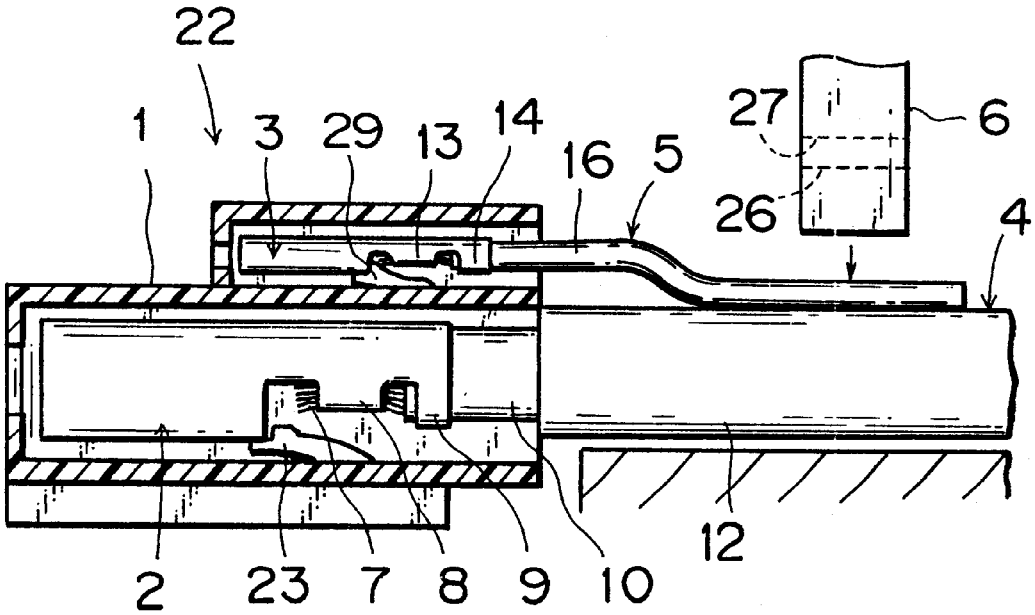
FIG. 1 is a vertical longitudinal section showing a connection method for a shielded cable according to one embodiment of this invention.

This connection method includes having terminals 2, 3 accommodated in two upper and lower tiers in a connector housing 1 of synthetic resin as shown in FIG. 1 and welding together with an ultrasonic welding horn 6 the cables 4, 5 attached to the respective terminals 2, 3, with one placed on the other.

The cable 4 of large diameter is a shielded cable, and the cable 5 of small diameter placed on the shielded cable 4 is a grounding lead wire as a relay connecting element. The terminal 2, which is of large size, is solderlessly connected to the shielded cable 4 for connecting to a mating terminal (not shown), and the terminal 3, which is of small size, is solderlessly connected to the lead wire 5 for grounding.

The terminal 2 has a forward flap 8 crimped on the conductor 7 of the shielded cable 4 and a rearward flap 9 crimped on the inner cover 10 of the shielded cable 4. The braid 11 (FIG. 2) and the outer cover 12 are both removed near the front end of the shielded cable 4 to have the inner cover 10 exposed. Likewise, the grounding terminal 3 has a forward flap 13 crimped on the conductor 15 of the lead wire 5 and a rearward flap 14 crimped on the insulating cover 16 of the lead wire 5.

Figure 2:
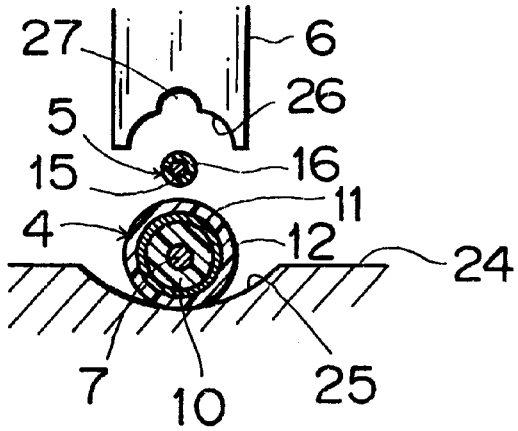
FIG. 2 is a vertical transverse section showing a lead wire and the shielded cable of FIG. 1 about to be subjected to ultrasonic welding.
Figure 3:
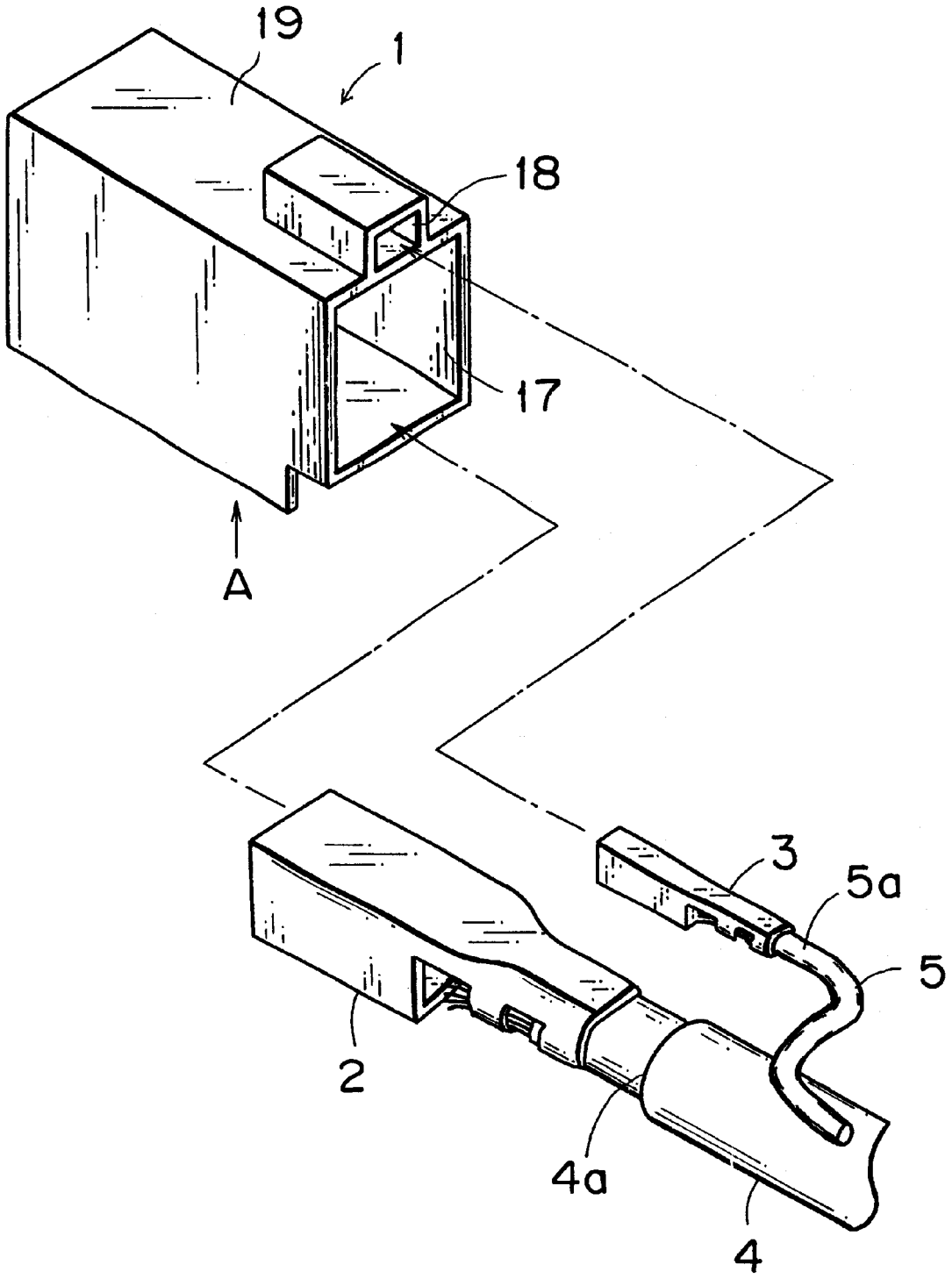
FIG. 3 is a perspective view showing terminals of FIG. 1 being inserted into the connector housing, the terminals carried by the shielded cable.

As shown in FIG. 2, the lead wire 5 is disposed in a parallel manner over the shielded cable 4 in vertical alignment with the latter. The relative positioning of the shielded cable 4 and the lead wire 5 is, as indicated in FIG. 1, effected by the insertion of their respective terminals 2, 3 into the connector housing 1. In other words, as shown in FIG. 3, at a center on top of a connector housing main terminal accommodating chamber 17, there is provided a secondary terminal accommodating chamber 18 such that their centers are located on the same vertical. This makes it possible that on completion of the insertion of the terminals 2, 3 into their respective terminal accommodating chambers 17, 18, the cables 4, 5 are at their base portions (front end portions) 4*a*, 5*a* positioned fast such that their lateral centers are in vertical alignment with each other. The lead wire 5 is thus positioned directly over the shielded cable 4.

Figure 4:
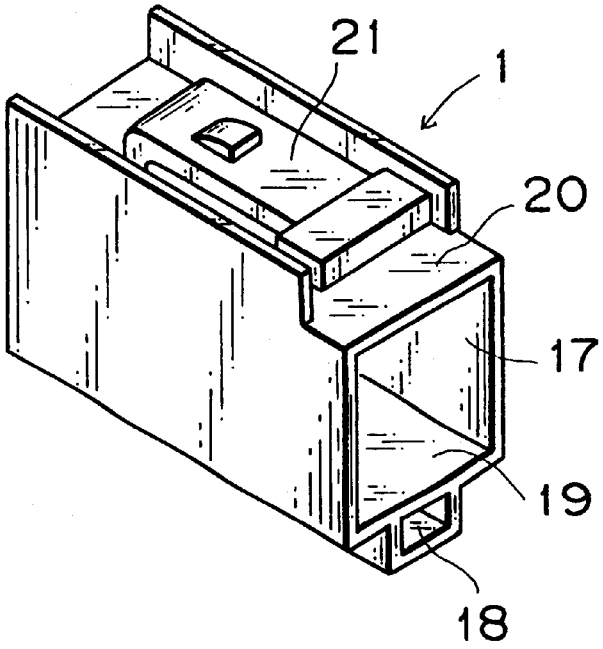
FIG. 4 is a perspective view showing the connector housing of FIG. 1, as viewed along an arrow A in FIG. 3.

As shown in FIG. 4, viewed along an arrow A in FIG. 3, the terminal accommodating chambers 17, 18 are partitioned by a wall 19 of the connector housing 1. On its wall 20 at a side opposite the secondary terminal accommodating chamber 18, the connector housing 1 has a locking arm 21 for locking engagement with the mating connector (not shown).

In FIG. 3, the terminals 2, 3 are received in the connector housing 1 to constitute the connector 2 (FIG. 1). The terminals 2, 3 are locked in position in the connector housing 1 by means of respective resilient locking lances 23, 29 (FIG. 1). In FIG. 1, on fitting the mating connector (not shown) to the connector 22, the terminals 2, 3 are connected with respective terminals (not shown) of the mating connector. After the terminals 2, 3 are inserted into the connector housing 1 as shown in FIG. 3, the lead wire 5 is welded to the shielded cable 5 by ultrasonic welding as shown in FIG. 2.

As shown in FIG. 2, the shielded cable 4 is disposed on the bottom of a longitudinally extended depression (curved surface) 25 provided on a support 24 of an untrasonic welding machine. The lead wire 5 is placed on the shielded cable 4. At the tip end of the ultrasonic welding horn 6, there are formed a first longitudinally extended positioning depression 26 for the shielded cable 4 and a second longitudinally extended positioning depression 27 for the lead wire 5.

The first depression 26 has a curved surface of semicircular shape which complies with the outer circumferential surface of the outer cover 12 of the shielded cable 4, and the second depression 27 has a curved surface of semi- or more-of-semi-circular shape which complies with the outer circumferential surface of the insulating cover 16 of the lead wire 5. The depth of the second depression 27 is smaller than the outer diameter of the lead wire 5 such that the lead wire 5 partly protrudes into the first depression 26. The second depression 27 is located at a circumferential center of the first depression 26. The wall thickness and width at the tip end of the ultrasonic welding horn 6 are substantially the same as will become apparent from comparison of FIGS. 1 and 2. Alternatively, the tip end of the ultrasonic welding horn 6 may be provided with V-shaped notches with tapered surfaces (not shown) for positioning the cables 4, 5.

The depressions 26, 27 of the ultrasonic welding horn 6 enable to position the lead wire 5 laterally at a center on top of the shielded cable 4. In other words, as the ultrasonic welding horn 6 descends, the lead wire 5 is first engaged in the second depression 27, followed by the engagement of the shielded cable 4 in the first depression 26. The curved surface of the second depression 27 strongly presses the lead wire 5 against the outer cover 12 of the shielded cable 4.

With a conventional ultrasonic welding horn with a flat tip end (not shown), the lead wire 5 tends to roll laterally out of place on the shielded cable 4, with the result that their relative positioning may not be attained. The curved surfaces of both depressions 26, 27 of the ultrasonic welding horn 6 in the present example, however, enable an easy and accurate relative positioning of the lead wire 5 and the shielded cable 4.

Figure 5:
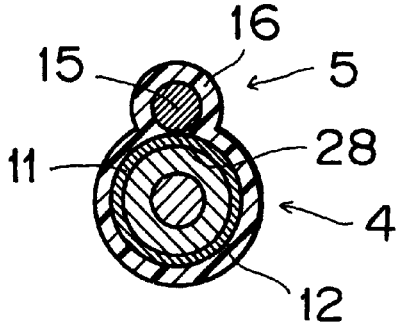
FIG. 5 is a vertical transverse section showing the lead wire and the shielded cable of FIG. 1 in a welded condition.
Figure 6:
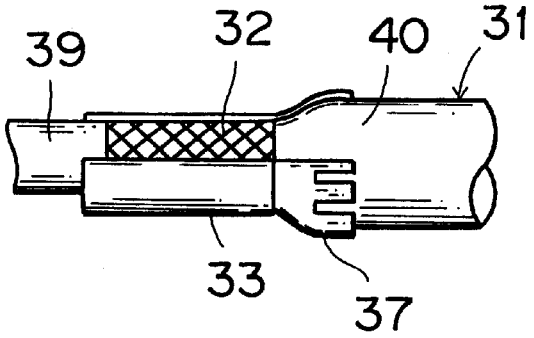
FIG. 6 PRIOR ART
FIG. 6 is a side view of a conventional connection means for a shielded cable.
Figure 7:
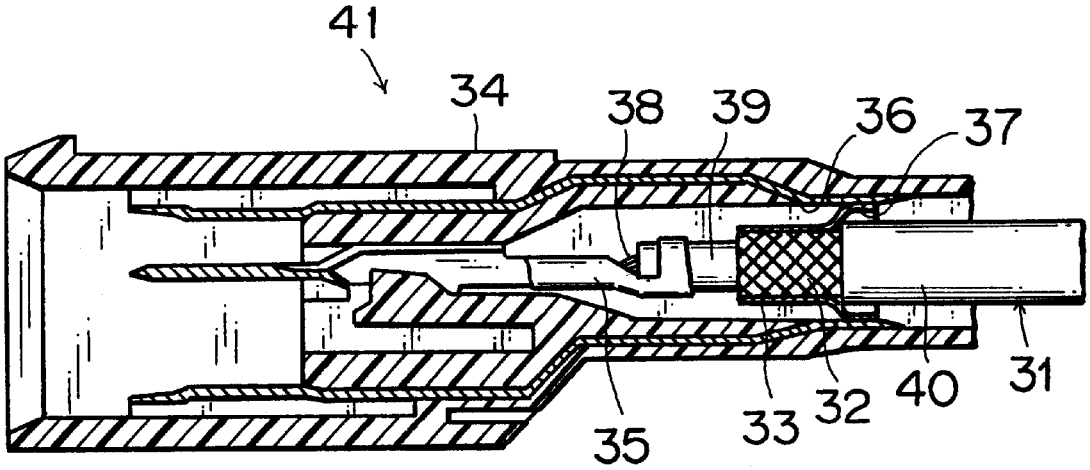
FIG. 7 PRIOR ART
FIG. 7 is a vertical longitudinal section showing the conventional shielded cable of FIG. 6, with its shield connected to a corresponding shield on the connector side.

By welding the lead wire 5 to the shielded cable 4 with the ultrasonic welding horn 6 in the manner described above, the insulating cover 16 of the lead wire 5 and the outer cover 12 of the shielded cable 4 are fused such that, as shown in FIG. 5, the conductor 15 of the lead wire 5 is brought into contact with and joined to the shielding braid 11 of the shielded cable 4. The fused parts of the insulating cover 16 and the outer cover 12 are set to cover and protect the joint 28 between the conductor 15 and the braid 11, and to secure the lead wire 5 to the shielded cable 4, thereby to prevent deterioration with time in the connection of the conductor 15 and the braid 11.

During the ultrasonic welding as in FIG. 2, the curved surface of the second depression 27 comes into close contact with the outer circumferential surface of the lead wire 5 and reliably conveys longitudinal vibrations of the ultrasonic welding horn 6 to the lead wire 5 so as to perform an efficient ultrasonic welding. If the rate of vibrations during the ultrasonic welding is increased, the conductor 15 of the lead wire 5 and the braid 11 of the shielded cable 4 are also welded together. If copper foil (not shown) is employed as the shield for the braid 11, the above structure of the present embodiment allows the conductor 15 of the lead wire 5 to be reliably joined to the copper foil of the shielded cable 4.

Thus, the peeling of the outer cover 12 to expose the braid 11 of the shielded cable 4 and the peeling of the insulating cover 16 to expose the conductor 15 of the lead wire 5 are eliminated. Moreover, the braid 11 of the shielded cable 4 and the conductor 15 of the lead wire 5 are firmly joined together, making the shield joint 28 (FIG. 5) reliable. Further, an automatic connecting machine for shielded cables can be easily constructed by adding an ultrasonic welding machine with the above-described ultrasonic welding horn 6 to an existing automatic terminal inserting machine (not shown).

Having now fully described the invention, it will be apparent to one of ordinary skill in the art that many changes and modifications can be made thereto without departing from the spirit and scope of the invention as set forth herein.

What is claimed is:

1. A shielded cable with a lead wire connected to a shield thereof, said wire being connected to said shield by a method comprising the steps of:

placing a lead wire having a longitudinal axis on a shielded cable having a longitudinal axis, with said longitudinal axes being disposed in a parallel and vertically aligned relationship with respect to each other; and then subjecting said lead wire and said shielded cable to ultrasonic welding such that a conductor of said lead wire is joined to a shield of said shield cable.

2. A method of connecting a lead wire to a shield of a shielded cable, comprising the steps of:

placing a lead wire having a longitudinal axis on a shielded cable having a longitudinal axis, with said longitudinal axes being disposed in a parallel and vertically aligned relationship with respect to each other; and then subjecting said lead wire and said shielded cable to ultrasonic welding such that a conductor of said lead wire is joined to a shield of said shield cable.

3. The method according to claim 2, wherein said shielded cable has a first terminal attached thereto and said lead wire has a second terminal attached thereto, and wherein said step of placing said lead wire on said shielded cable comprises inserting said first and second terminals in vertically aligned tiers into a connector housing to place said lead wire in a parallel manner on said shielded cable.

4. The method according to claim 1 or 2, wherein said step of ultrasonic welding is effected using an ultrasonic welding horn with a first positioning depression for said shielded cable and a second positioning depression for said lead wire.

5. The method according to claim 4, wherein said second positioning depression for said lead wire is located at a circumferential center of said first positioning depression for said shielded cable.

6. The method according to claim 2, wherein said shield of said shielded cable is a shielding braid.

7. The method according to claim 2, wherein said shield of said shielded cable is copper foil.

* * * * *